United States Patent [19]

Katada et al.

[11] Patent Number: 4,829,869

[45] Date of Patent: May 16, 1989

[54] TONE CONTROL APPARATUS FOR ELECTRONIC MUSICAL INSTRUMENT

[75] Inventors: Naota Katada; Kosei Terada, both of Hamamatsu, Japan

[73] Assignee: Yamaha Corporation, Hamamatsu, Japan

[21] Appl. No.: 7,116

[22] Filed: Jan. 27, 1987

[30] Foreign Application Priority Data

Jan. 29, 1986 [JP] Japan ..... 61-017337
Jan. 29, 1986 [JP] Japan ..... 61-017338

[51] Int. Cl.[4] ..... G10H 1/06; G10H 1/24; G10H 1/46; G10H 7/00

[52] U.S. Cl. ..... 84/1.19; 84/1.01; 84/1.27; 84/1.28

[58] Field of Search ..... 84/1.01, 1.19, 1.28, 84/1.24, 1.27, DIG. 22

[56] References Cited

U.S. PATENT DOCUMENTS

| | | | |
|---|---|---|---|
| 3,897,709 | 8/1975 | Hiyoshi et al. | 84/1.19 |
| 4,244,261 | 1/1981 | Adachi | 84/1.24 |
| 4,327,622 | 5/1982 | Aoki | 84/DIG. 22 X |
| 4,358,980 | 11/1982 | Imamura | 84/1.19 |
| 4,419,916 | 12/1983 | Aoki | 84/1.01 |
| 4,432,265 | 2/1984 | Oya et al. | 84/1.19 X |
| 4,475,429 | 10/1984 | Suzuki | 84/1.19 |
| 4,538,495 | 9/1985 | Sato | 84/1.19 |
| 4,773,294 | 9/1988 | Iizuka et al. | 84/1.01 |

FOREIGN PATENT DOCUMENTS 0192984 9/1986 United Kingdom ..... 84/1.01

*Primary Examiner*—A. T. Grimley
*Assistant Examiner*—John G. Smith
*Attorney, Agent, or Firm*—Spensley Horn Jubas & Lubitz

[57] ABSTRACT

A tone control apparatus for use in an electronic musical instrument is responsive to an easily accessible switch such as a foot-lever switch to control conditions of muscial tone which include, for example, a tone pitch, a tone color, a tone volume and a tone effect. The tone control apparatus has a keyboard for designating a frequency of a musical tone to be generated and a musical tone generating circuit for generating a musical tone having a frequency designated by the keyboard. The tone control apparatus further has a memory for storing a plurality of groups of tone control data. Each time the foot-lever switch is operated by the performer, one of the tone control data group is read and supplied to the musical tone generating circuit to control the conditions of the generating musical tone. In a first mode, the plurality of tone control data groups are sequentially read in synchronization with the operations of the foot-lever switch. In a second mode, the tone control group designated by a group number, which has been preset by the operator, is read. Thus, the performer can change the conditions of the generating musical tone by operating the foot-lever switch with his foot even when performing music on the keyboard with his both hands.

20 Claims, 10 Drawing Sheets

TONE CONTROL APPARATUS FOR ELECTRONIC MUSICAL INSTRUMENT

BACKGROUND OF THE INVENTION

1. Field of the Invention

This invention relates generally to a tone control apparatus for an electronic musical instrument for controlling conditions of tone such as a tone pitch, tone color, tone volume and a tone effect, and more particularly to a tone control apparatus of the preset type in which a plurality of groups of tone control data are previously stored in a memory so that such conditions of tone can be changed by reading a desired one of the plurality of groups of tone control data.

2. Prior Art

Conventionally, a tone control apparatus of such preset type comprises a plurality of preset switches or levers corresponding respectively to the plurality of groups of tone control data. When any one of the preset switches is operated, all the control data of the group corresponding to the operated preset switch are read from the memory so that the conditions of tone such as a tone pitch, tone color, tone volume and a tone effect are changed in accordance with the read control data. Thus, the performer can simultaneously change such conditions of tone only by operating a desired one of the preset switches, so that it is not necessary for the performer to operate, one after another, a plurality of tone control switches for controlling, for example, a tone pitch, a tone color, a tone volume and a tone effect, respectively.

With such conventional tone control apparatus, the plurality of preset switches are provided, in general, on a part of the electronic musical instrument so as to be arranged in one or more rows. Therefore, during performing a music, the performer must determine by his eye which one of the preset switches should be operated. It is however difficult for an unskilled performer to carry out such an operation during performing a music. In particular, it is very difficult even for a skilled performer to carry out such an operation during performing a phrase of the music which requires quick manipulations of keys of the keyboard.

Japanese Patent Laid-Open No. 57-85094 discloses another conventional tone control apparatus in which a plurality of groups of tone control data, each group corresponding to a measure of a music, are previously stored in the order of advance of the music. The plurality of tone control data are read out one after another in accordance with tempo signals, each representative of a boundary between two adjoining measures, to control the conditions of tone based on plural data contained in each read group of tone control data. Thus, the conditions of tone are automatically and sequentially changed in accordance with the advance of the music. The performer can also change, during performing the music, the conditions of tone without operating any tone control switches.

With this conventional tone control apparatus, however, the performer must store a suitable tone control data group for each measure of the music before performing the music. Thus, this conventional tone control apparatus requires much time and work before performing each set of music, and imposes a burden on the performer particularly in the case of a long music. Furthermore, since the control of tone conditions effected in accordance with the advance of the music is determined only by the groups of tone control data previously stored in the memory, the performer can not change the conditions of tone even if he so desires.

SUMMARY OF THE INVENTION

It is therefore an object of the present invention to provide a tone control apparatus of the preset type in which the conditions of musical tone can be changed by a simple operation.

It is another object of the present invention to provide such a preset-type tone control apparatus that the performer can change the conditions of tone at will even in the process of performing a music.

According to an aspect of the present invention, there is provided a tone control apparatus for use in an electronic musical instrument comprising tone-frequency designating means for outputting a frequency-designation signal which designates a frequency of a musical tone to be generated; musical tone generating means responsive to the frequency-designation signal for generating a musical tone having the frequency designated by the tone-frequency designating means; memory means for storing a plurality of groups of tone control data each group for controlling conditions of the musical tone generated by the musical tone generating means; signal generating means having a manually operable member mounted on the electronic musical instrument for generating an operation signal each time the member is operated; and reading means for reading the plurality of control data groups from the memory means one by one in a predetermined order in synchronization with the operation signals generated by the signal generating means; the musical tone generating means being further responsive to each control data group read by the reading means for controlling the conditions of the generated musical tone.

According to another aspect of the invention, there is provided a tone control apparatus for use in an electronic musical instrument comprising: tone-frequency designating means for outputting a frequency-designation signal which designates a frequency of a musical tone to be generated; musical tone generating means responsive to the frequency-designation signal for generating a musical tone having the frequency designated by the tone-frequency designating means; memory means for storing a plurality of groups of tone control data each group for controlling conditions of the musical tone generated by the musical tone generating means; signal generating means having a manually operable member mounted on the electronic musical instrument for generating an operation signal each time the member is operated; designation data providing means for providing designation data designating one of the plurality of tone control data groups; and reading means responsive to the operation signal for reading, from the memory means, the control data group designated by the designation data, the musical tone generating means being further responsive to the read control data group for controlling the conditions of the generated musical tone.

DESCRIPTION OF THE PREFERRED EMBODIMENTS OF THE INVENTION

A first embodiment of the present invention will now be described with reference to the accompanying drawings.

Figure 1:
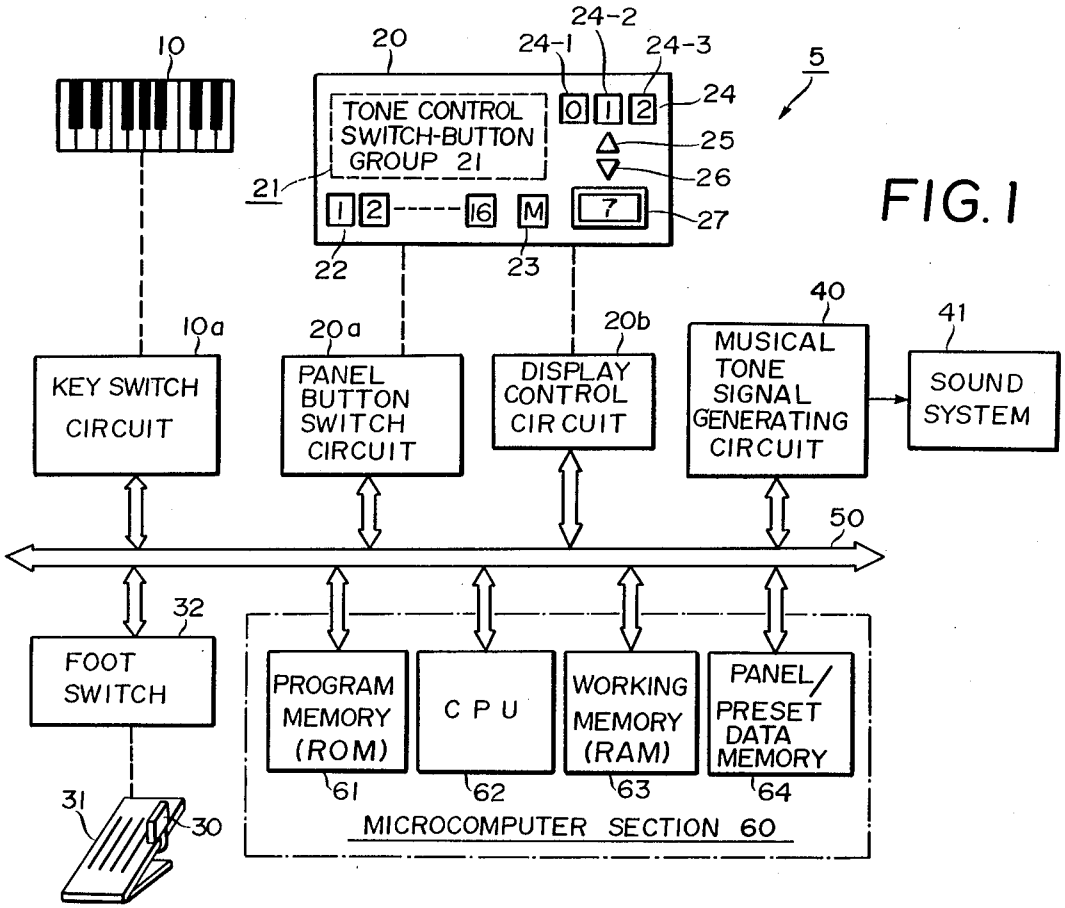
FIG. 1 is a block diagram of an electronic musical instrument 5 including a tone control apparatus provided in accordance with a first embodiment of the present invention.

FIG. 1 shows an electronic musical instrument 5 including a tone control apparatus provided in accordance with the first embodiment of the invention. The electronic musical instrument 5 comprises a keyboard 10 for designating a tone pitch of a musical tone to be generated, and also comprises a control panel 20 and a foot lever 30 both for controlling a tone pitch, a tone color, a tone volume and a tone effect of the musical tone. The electronic musical instrument 5 further comprises a musical tone signal generating circuit 40 for generating a musical tone signal representative of the musical tone, and a microcomputer section 60 for transferring control data through a signal bus 50 to the musical tone signal generating circuit 40, the control data being determined in accordance with the operations of the keyboard 10, the control panel 20 and the foot lever 30.

The keyboard 10 includes an upper keyboard to be operated normally by the right hand of the performer, a lower keyboard to be operated by the left hand and a pedal keyboard to be operated by the left foot. Each of the upper, lower and pedal keyboards has a plurality of keys each for designating a tone pitch of a musical tone to be generated. A key switch circuit 10*a* comprises a plurality of key switches each corresponding to a respective one of the keys of the keyboard 10. Each key switch of the key switch circuit 10*a* is responsive to a key depression/release detection control signal fed through the signal bus 50 from the microcomputer section 60 to output keystate data representative of a depression or a release of the corresponding key through the signal bus 50 to the microcomputer section 60.

The control panel 20 is disposed in the vicinity of the upper and lower keyboards so that the performer can operate switch-buttons of the control panel 20 by his right or left hand. Provided on the control panel 20 are a tone control switch-button group 21, a preset switch-button group 22 composed of plural preset switch-buttons arranged in one row, a memory switch-button 23, a mode selection switch-button group 24, an up-control switch-button 25, a down-control switch-button 26 and a display unit 27. The tone control switch-button group 21 comprises a plurality of tone control switch-buttons (a hundred buttons in this embodiment) for respectively controlling conditions of a musical tone formed by the musical tone signal generating circuit 40, the conditions including a tone pitch, a tone color, a tone volume, a tone effect and so on (a hundred kinds of conditions in this embodiment). The preset switch-button group 22 comprises, for example, first to sixteenth preset switch-buttons which correspond respectively to first to sixteenth preset data groups as later described, each preset switch-button designating the corresponding one of the preset data groups which is to be written or read. The memory switch-button 23 is operated to write the preset data group designated by the preset switch-button group 22. The mode selection switch-button group 24 comprises three mode selection switch-buttons $24_1$, $24_2$ and $24_3$ which are provided to select one of first to third modes to be given to the foot lever 30. More specifically, the mode selection switch-button 241 selects the first mode ("0") in which the foot lever 30 is disabled, the mode selection switch-button 242 selects the second mode ("1") in which the first to sixteenth preset data groups are read one by one in this order in response to each turning-on operation of the foot lever 30, and the mode selection switch-button $24_3$ selects the third mode ("2") in which the preset data group previously designated by the performer are read in response to a turning-on operation of the foot lever 30 irrespective of the above order. The up-control switch-button 25 and the down-control switch-button 26 are operated to increment and decrement the number of the preset data group to be designated in the third mode to thereby render the number a desired value. The display unit 27 displays the number of the preset data group currently read in the second mode or the number of the preset data group designated in the third mode. Each of the switch-buttons of the switch-button groups 21, 22 and 24 incorporates an indicator such as an LED for indicating the operation state thereof. A panel button switch circuit 20*a* comprises a plurality of switches corresponding respectively to the button switches of the switch-button groups 21 and 22 and the switch buttons 23, $24_1$, $24_2$, $24_3$, 25 and 26. Each of the switches of the panel button switch circuit 20*a* is responsive to a switch detection control signal fed through the signal bus 50 from the microcomputer section 60 to output data representative of the operation state of the corresponding switch-button through the signal bus 50 to the microcomputer section 60. A display control circuit 20*b* controls display of data on the display unit 27 and activations of the indicators incorporated in the switch-buttons of the switch-button groups 21, 22 and 24 in accordance with display control data fed thereto through the signal bus 50 from the microcomputer section 60.

The foot lever 30 is mounted on an expression pedal 31 which is disposed at the bottom of the front portion of the electronic musical instrument 5 and stepped on usually by the right foot. The foot lever 30 is also operated by the right foot to become ON to thereby control the reading of the preset data group in each of the aforesaid modes. A foot switch 32 is provided correspondingly to the foot lever 30, and is responsive to the switch detection control signal fed through the signal bus 50 from the microcomputer section 60 to output data representative of the operation state of the foot lever 30 through the signal bus 30 to the microcomputer section 60.

The musical tone signal generating circuit 40 comprises a plurality of musical tone generating channels less in number than the keys of the keyboard 10 and a tone effect circuit. The musical tone generating channels and the tone effect circuit form and output the musical tone signal whose tone conditions, such as a frequency or a pitch of tone, a tone color, a tone volume, a tone effect, are controlled in accordance with key data and musical tone control data. The key data and the musical tone control data are supplied through the signal bus 50 from the microcomputer section 60 in response to key operation on the keyboard 10, operation of the switch-buttons of the control panel 20 and operation of the foot lever 30. A sound system 41 comprises an amplifier, a loudspeaker and so on, and outputs the musical tone signal fed from the musical tone signal generating circuit 40 as a musical tone.

The microcomputer section 60 comprises a program memory 61, a central processing unit (hereinafter referred to as "CPU") 62, a working memory 63 and a panel/preset data memory 64. The program memory 61 is composed of a read only memory (hereinafter referred to as "ROM"), and stores programs whose flow charts are shown in FIGS. 3 to 7. The CPU 62 executes the programs stored in the ROM 61. The working memory 63 is composed of a random access memory (hereinafter referred to as "RAM"), and temporarily stores data and variables necessary for executing the programs. These variables and data are as follows:

Key-state data KEYDT—data representative of the state of each key of the keyboard 10;

Switch-state data SWDT—data representative of the state of each of the switch-buttons of control panel 20 and the foot lever 30;

Mode data MODE—data which takes one of "0", "1" and "2" representative respectively of the first, second and third modes designated respectively by the mode selection switch-buttons $24_1$, $24_2$ and $24_3$;

Sequence number SEQ—data representative of the number of the preset data group read out in response to the operation of the foot lever 30 in the second mode (SEQ takes any one of "1" to "16");

Jump number JUMP—data representative of the number of the preset data group read out in response to the operation of the foot lever 30 in the third mode (JUMP takes any one of "1" to "16");

Preset number "n"—variable used when writing or reading of the preset data group is performed, and representing the number of the preset data group ("n" takes any one of "1" to "16"); and Data number j—variable used when writing or reading of the preset data group is performed, and representing the number of each preset data contained in the preset data group (j takes any one of "1" to "100").

Figure 2:
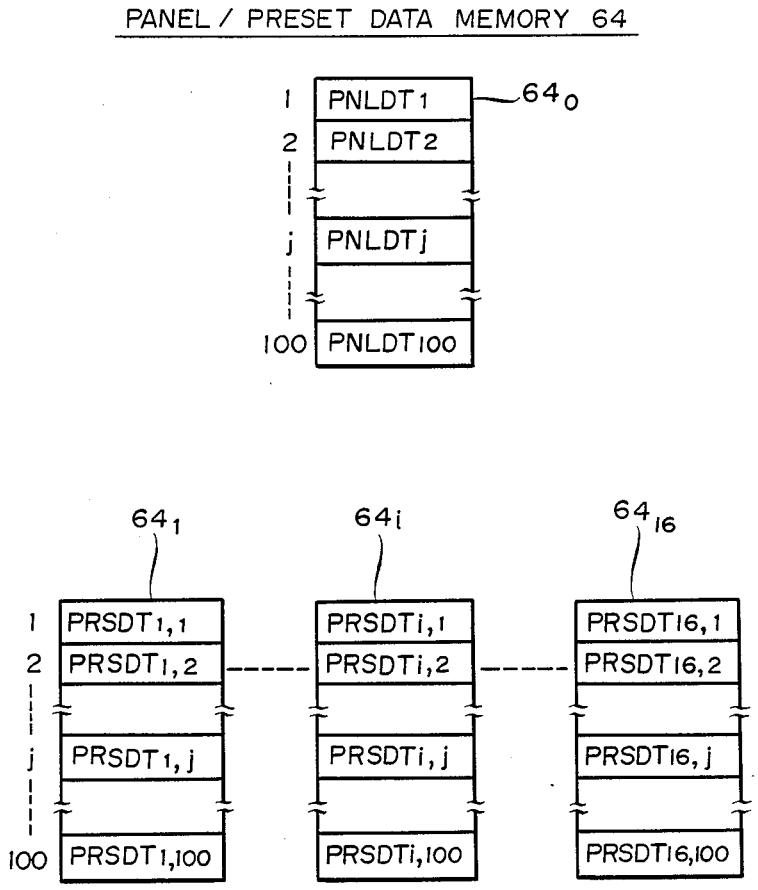
FIG. 2 is an illustration showing various registers provided in the panel/preset data memory 64 of the electronic musical instrument 5 of FIG. 1.

The panel/preset data memory 64 is composed of a RAM and stores musical tone control data selected by the tone control switch-button groups 21, the musical tone control data being for controlling the conditions of tone such as a tone pitch, a tone color, a tone volume and a tone effect. The memory 64 is divided, as shown in FIG. 2, a panel data register group $64_0$ and first to sixteenth preset data register groups $64_1$ to $64_{16}$. The panel data register group $64_0$ comprises first to 100th registers which store musical tone control data, necessitated by the musical tone signal generating circuit 40 to form a current musical tone, as panel data $PNLDT_1$ to $PNLDT_{100}$, respectively. The states of the controls of musical tone effected in accordance with the panel data $PNLDT_1$ to $PNLDT_{100}$ are indicated on the control panel 20 by the indicators incorporated in the switch-buttons of the tone control switch-button group 21. The preset data register groups $64_1 \ldots 64_i \ldots 64_{16}$ store the musical tone control data as preset data $PRSDT_{1,1}$ to $PRSDT_{1,100}$ . . . $PRSDT_{i,1}$ to $PRSDT_{i,100}$ . . . $PRSDT_{16,1}$ to $PRSDT_{16,100}$, respectively. The preset data $PRSDT_{i,j}$ represents that preset data stored in the jth register of the ith preset register group $64_i$, wherein "i" is any integer between "1" and "16" and "j" is any integer between "1" and "100".

The operation of the above-described electronic musical instrument 5 will now be described with reference to the flow charts of FIGS. 3 to 7.

Figure 3:
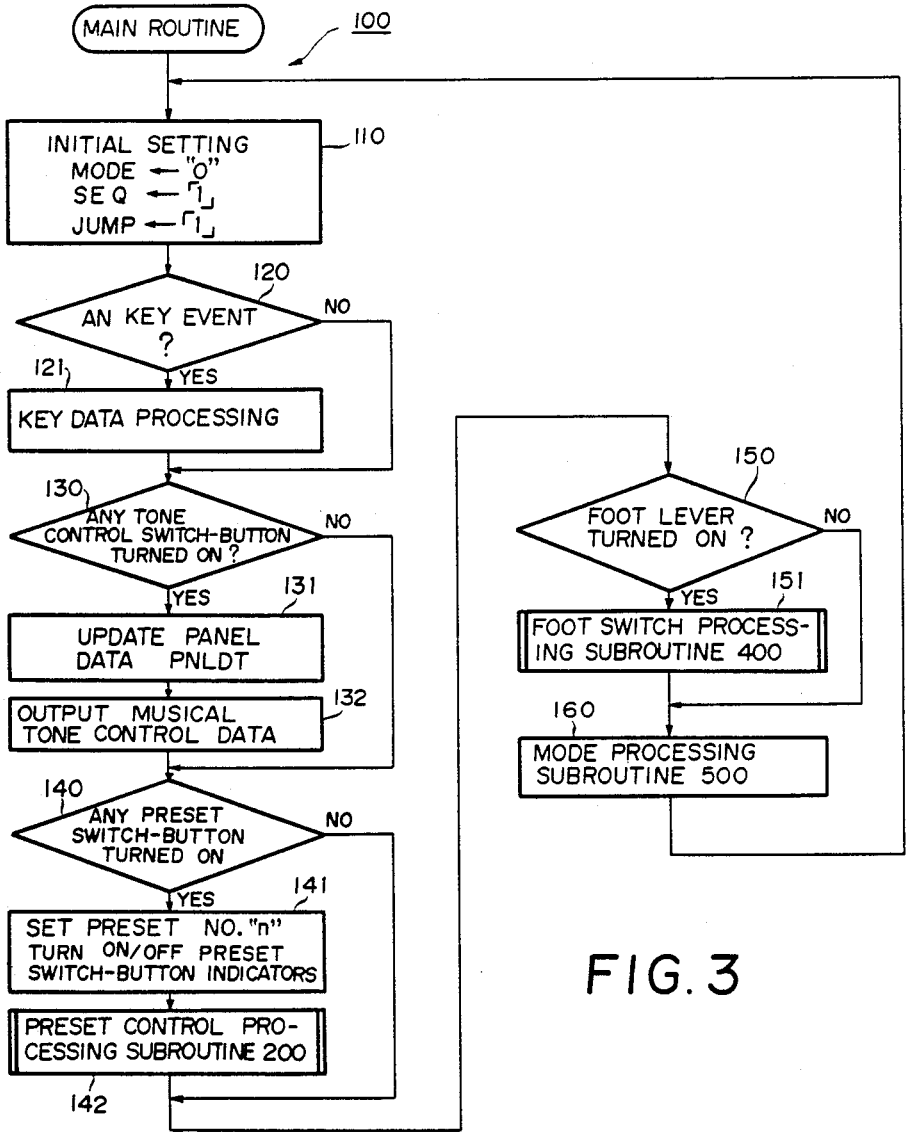
FIG. 3 is a flow chart of a main routine 100 executed by the CPU 62 if the electronic musical instrument 5 of FIG. 1.

When a power switch (not shown) provided on the control panel 20 is turned on, the CPU 62 begins to execute a main routine 100 shown in FIG. 3. At the first step 110 of the main routine 100, the CPU 62 initializes various data and variables. By this initialization, the mode data MODE, the sequence number SEQ and the jump number JUMP are rendered "0", "1" and "1", respectively.

After the initialization, the CPU 62 outputs, at step 120, the key depression/release detection control signal through the signal bus 50 to the key switch circuit **10*a* to input key-state data representative of the most recent state of the keys of the keyboard 10. The CPU 62 compares the inputted key-state data with the key-state data KEYDT, stored in the working memory 63 and representing the preceding state of the keys, to detect any change of operation of the keys, that is, any depression and release of a key or keys of the keyboard 10. Thus, it is determined at the step 120 whether there was a new depression of key or a new release of key on the keyboard 10. If the determination result is "NO", that is, if it is determined that there was no key operation (or no key event), the CPU 62 transfers its control to step 130. On the other hand, if there was a new depression of key or a new release of key on the keyboard 10, the result of the determination performed by the CPU 62 at the step 120 becomes "YES". In this case, the CPU 62 replaces the key-state data KEYDT, stored in the working memory 63 and corresponding to the operated key, with the most recent key data of the operated key received from the key switch circuit 10*a* so that a new depression or release of key can be detected at the same step 120 during the next pass. The processing then proceeds to step 121 at which a key data processing routine is executed. In this key data processing routine, if the detected key event was a depression of key, the CPU 62 carries out a key assigning processing for assigning the depressed key to one of the plurality of musical tone generating channels of the musical tone signal generating circuit 40. The CPU 62 then outputs key-on data representative of the key depression and key data representative of the depressed key together with channel data representative of the above assigned channel through the signal bus 50 to the musical tone signal generating circuit 40. The musical tone signal generating circuit 40 causes, in response to these data, the musical tone generating channel designated by the channel data to generate a musical tone signal of a tone pitch designated by the key data. On the other hand, if the key event was a release of key, the CPU 62 searches for the musical tone generating channel of the musical tone signal generating circuit 40 which is generating the musical tone signal corresponding to the released key. The CPU 62 then outputs channel data representative of this channel and key-off data representative of the key release through the signal bus 50 to the musical tone signal generating circuit 40. The musical tone signal generating circuit 40** stops, in response to these data, the generation of musical tone signal at the musical tone generating channel designated by the above channel data.

After completing the processing at the step 121, the CPU 62 outputs, at step 130, the switch detection control signal through the signal bus 50 to the switch group of the panel button switch circuit 20*a* which corresponds to the tone control switch-button group 21. The CPU 62 then reads through the signal bus 50 switch-state data representative of the most recent operation state of each of the switch-buttons of the tone control switch-button group 21 from the above switch group in the panel button switch circuit 20*a*. The CPU 62 subsequently compares the read switch-state data with the switch-state data SWDT, stored in the working memory 63 and representing the preceding state of the tone control switch-button group 21, to detect those tone control switch-buttons of the tone control switch-button group 21 which were newly turned on. When no switch-button of the tone control switch-button group 21 has been operated, or when any switch-button of the switch-button group 21 has been kept in the ON state, or when any switch-button of the switch-button group 21 was released from the ON state, that is to say, when no switch-button of the tone control switch-button group 21 has been turned on, the CPU 62 determines that there was no new turning-on operation of switch-button. Thus, the result of the determination at the step 130 becomes "NO", so that the processing proceeds to step 140. In the case where any of the switch-buttons of the switch-button group 21 was released from the ON state, the CPU 62 replaces at the step 130 the switch-state data SWDT, stored in the working memory 63 and corresponding to the released key, with the most recent switch-state data relating to the released key so that a new turning-on operation of each switch-button of the tone control switch-button group 21 can be detected at the same step 130 during the next pass.

On the other hand, when any of the switch-buttons of the tone control switch-button group 21 has been turned on, the result of the determination effected by the CPU 62 at the step 130 becomes "YES". In this case, the CPU 62 replaces at the same step 130 the switch-state data SWDT, stored in the working memory 63 and corresponding to the switch-button thus turned on, with the most recent switch-state data relating to the turned-on switch-button so that a new turning-on operation of each switch-button of the tone control switch-button group 21 can be detected at the same step 130 during the next pass. Then, the CPU 62 transfers its control to step 131. At this step 131, the CPU 62 stores the musical tone control data, changed in accordance with the switch-button thus turned on, into a corresponding one of the registers of the panel data register group $64_0$, so that the panel data $PNLDT_1$ to $PNLDT_{100}$ are updated in accordance with the operation states of the switch-buttons of the tone control switch-button group 21. After updating these data, the CPU 62 outputs the thus updated panel data $PNLDT_1$ to $PNLDT_{100}$ to the musical tone signal generating circuit 40 at the next step 132. The musical tone signal generating circuit 40 controls the conditions of the musical tone formed thereby, that is, the tone pitch, the tone color, the tone volume, the tone effect an so on, in accordance with the supplied panel data $PNLDT_1$ to $PNLDT_{100}$. Thus, the conditions of the generating musical tone are changed in accordance with the operation of each switch-button of the tone control switch-button group 21. At the same step 132, the CPU 62 outputs the display control data, which correspond to the updated panel data $PNLDT_1$ to $PNLDT_{100}$, through the signal bus 50 to the display control circuit 20*b*. The display control circuit 20*b* controls turning-on and turning-off of the indicators incorporated respectively in the switch-buttons of the tone control switch-button group 21. As a result, the current states of the musical tone control data stored in the panel data register group $64_0$ as the panel data $PNLDT_1$ to $PNLDT_{100}$, that is, the control conditions for the musical tone presently generated by the musical tone signal generating circuit 40, are displayed on the control panel 20.

After completing the processing at the step 132, the CPU 62 outputs, at step 140, the switch detection control signal through the signal bus 50 to the switch group of the panel button switch circuit 20*a* which corresponds to the preset switch-button group 22. The CPU 62 then reads through the signal bus 50 switch-state data representative of the most recent operation state of each of the switch buttons of the preset switch-button group 22 from the above switch group in the panel button switch circuit 20*a*. The CPU 62 subsequently compares the read switch-state data with the switch-state data SWDT, stored in the working memory 63 and representing the preceding state of the preset switch-button group 22, to detect those preset switch-buttons of the preset switch-button group 22 which were newly turned on. When no switch-button of the preset switch-button group 22 has been operated, or when any switch-button of the switch-button group 22 has been kept in the ON state, or when any switch-button of the switch-button group 22 was released from the ON state, that is to say, when no switch-button of the preset switch-button group 22 has been turned on, the CPU 62 determines that there was no new turning-on operation of switch-button. Thus, the result of the determination at the step 140 becomes "NO", so that the processing proceeds to step 150. In the case where any of the switch-buttons of the switch-button group 22 was released from the ON state, the CPU 62 replaces at the same step 140 the switch-state data SWDT in the working memory 63, which corresponds to the released key, with the most recent switch-state data relating to the released key so that a new turning-on operation of each switch-button of the preset switch-button group 22 can be detected at the same step 140 during the next pass.

On the other hand, when any of the switch-buttons of the preset switch-button group 22 has been turned on, the result of the determination effected by the CPU 62 at the step 140 becomes "YES". In this case, the CPU 62 replaces at the step 140 the switch-state data SWDT in the working memory 63, which corresponds to the switch-button thus turned on, with the most recent switch-state data relating to the turned-on switch-button so that a new turning-on operation of each switch-button of the preset switch-button group 22 can be detected at the same step 140 during the next pass. Then, the CPU 62 transfers its control to step 141. At this step 141, the CPU 62 sets the preset number "n" to a value representative of the number of the turned-on preset switch-button, and outputs the display control data for turning on the indicator incorporated in the turned-on switch-button to the display control circuit **20*b*. The display control circuit 20*b* turns on the indicator incorporated in the switch-button of the preset switch-button group 22 turned on, and turns off all indicators incorporated in the other preset switch-buttons. After completing the processing at the step 141, the CPU 62 reads at the next step 142 a subroutine 200 for "preset control processing", of which flow chart is shown in FIG. 4**, and executes this subroutine.

Figure 4:
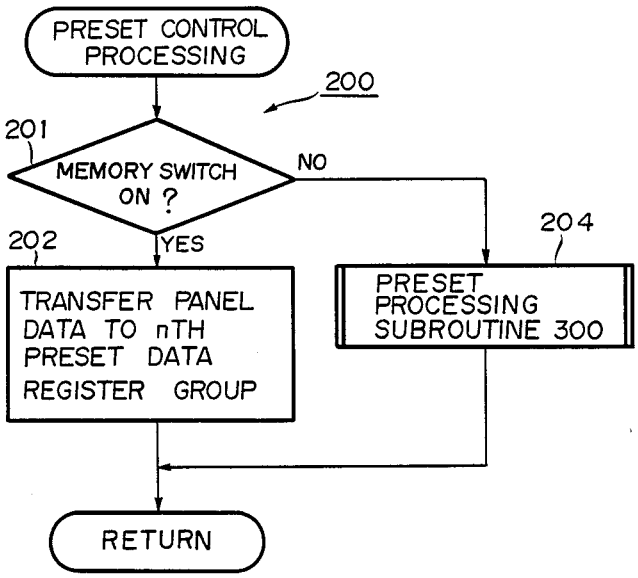
FIG. 4 is a flow chart of the preset control processing subroutine 200 executed by the CPU 62 at the step 142 of FIG. 3.

The CPU 62 begins to execute the preset control processing subroutine 200 at step 201 of FIG. 4. At this step 201, the CPU 62 outputs the switch detection control signal through the signal bus 50 to the switch of the panel button switch circuit **20*a* which corresponds to the memory switch-button 23. The CPU 62 then reads through the signal bus 50 switch-state data representative of the mos recent operation state of the memory switch-button 23 from the above switch of the panel button switch circuit 20*a*, and determines in accordance with the read switch-state data whether the memory switch-button 23 is in the ON state. If the determination result at the step 201 is "YES", that is, if the CPU 62 determines that the memory switch-button 23 is in the ON state, the CPU 62 transfers at step 202 the panel data $PNLDT_1$ to $PNLDT_{100}$ stored in the panel data register group $\mathbf{64_0}$ shown in FIG. 2 to that register group among the preset data register groups $\mathbf{64_1}$ to $\mathbf{64_{16}}$ which corresponds to the preset number "n" set by the processing at the step 141, that is, the preset data register group $\mathbf{64_n}$. As a result, all the panel data $PNLDT_1$ to $PNLDT_{100}$ are stored respectively into the first to 100th registers of the nth preset data register group $\mathbf{64_n}$. In other words, the data $PRSDT_{n,1}$ to $PRSDT_{n,100}$ in the first to 100th registers of the nth preset data register group $\mathbf{64_n}$ are set to values equal respectively to the panel data $PNLDT_1$ to $PNLDT_{100}$. Thus, the performer can set the contents of any desired one of the first to 16th preset data register group $\mathbf{64_1}$ to $\mathbf{64_{16}}$ to appropriate values, by first changing the panel data $PNLDT_1$ to $PNLDT_{100}$ through the processing of the step 131 which is performed in response to each operation of switch-button of the tone control switch-button group 21, and then turning on the preset switch-button corresponding to the desired preset data register group with the memory switch-button 23 being turned on. By repeating an operation similar to the above operation, various kinds of musical tone control data can be stored into the first to 16th preset data register groups $\mathbf{64_1}$ to $\mathbf{64_{16}}$ as the preset data $PRSDT_{1,1}$ to $PRSDT_{1,10}$ . . . $PRSDT_{i,1}$ to $PRSDT_{i,100}$ . . . $PRSDT_{16,1}$ to $PRSDT_{16,100}$. When the processing at the above step 202 is completed, this preset control processing subroutine 200 is terminated, and the processing returns to the main routine 100 at step 150 (FIG. 3**).

Figure 5:
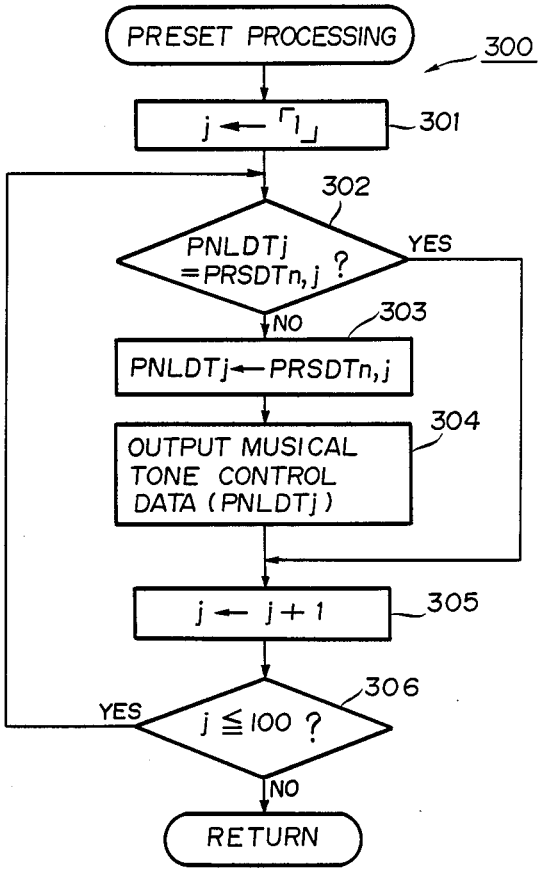
FIG. 5 is a flow chart of the preset processing subroutine 300 executed by the CPU 62 of the electronic musical instrument 5 of FIG. 1.

On the other hand, when it is determined at the step 201 (FIG. 4) that the memory switch-button 23 has not been turned on, that is, when the result of the determination is "NO", the CPU 62 reads a subroutine 300 for "preset processing", of which flow chart is shown in FIG. 5, and executes it. The CPU 62 begins to execute the preset processing subroutine 300 from step 301 at which the data number "j" is rendered "1". The CPU 62 then determines, at the next step 302, whether the jth ("j" is initially "1") panel data $PNLDT_j$ contained in the panel data register group $\mathbf{64_0}$ shown in FIG. 2 coincides with the jth preset data $PRSDT_{n,j}$ contained in the nth preset data register group $\mathbf{64_n}$ designated by the preset number "n" set by the processing at the step 141 (FIG. 3). If the CPU 62 determines that both data $PNLDT_j$ and $PRSDT_{n,j}$ coincide with each other, that is, if the result of the determination at the step 302 is "YES", then the processing proceeds to step 305. On the other hand, if the CPU 62 determines that both data $PNLDT_j$ and $PRSDT_{n,j}$ differ from each other, that is, if the result of the determination at the step 302 is "NO", the CPU 62 sets the panel data $PNLDT_j$ to a value equal to the preset data $PRSDT_{n,j}$ at step 303. At the next step 304, the CPU 62 outputs this data $PNLDT_j$ through the signal bus 50 to the musical tone signal generating circuit 40, and also outputs display control data corresponding to the data $PNLDT_j$ through the signal bus 50 to the display control circuit **20*b*. The musical tone signal generating circuit 40 changes the conditions of the musical tone formed thereby in accordance with the supplied panel data $PNLDT_j$, and the display control circuit 20*b* turns on or off the indicator incorporated in the corresponding switch-button of the ton control switch-button group 21** in accordance with the supplied display control data.

upon completing the processing at the step 302 or the step 304, the CPU 62 adds "1" to the data number "j" (="1"), at step 305, to cause the data number "j" to become "2". At the next step 306, the CPU 62 determines whether the data number "j" is less than "101". In this case, since "j" is "2", the result of the determination at the step 306 is "YES", so that the processing returns to the step 302. The CPU 62 performs the processing of from the step 302 to the step 304 in a manner similar to the above, increments the data number "j" by "1", and again performs the processing of from the step 302 to the step 304. Thus, the CPU 62 sequentially increments the data number "j" by "1" to cyclicly carry out the processing of from the step 302 to the step 306, so that the first to 100th panel data $PNLDT_1$ to $PNLDT_{100}$ are sequentially replaced respectively with the first to 100th preset data $PRSDT_{n,1}$ to $PRSDT_{n,100}$. If the data number "j" becomes greater than "100", the result of the determination at the step 306 becomes "NO", so that the processing of this preset processing subroutine 300 is terminated, and the processing returns to the step 150 of the main routine 100. According to the above-described preset processing subroutine 300, the first to 100th panel data $PNLDT_1$ to $PNLDT_{100}$ are set to values equal to the preset data $PRSDT_{n,1}$ to $PRSDT_{n,100}$ in the nth preset data register group $\mathbf{64_n}$, and the conditions of the musical tone formed by the musical tone signal generating circuit 40 are controlled in accordance with these panel data $PNLDT_1$ to $PNLDT_{100}$. Therefore, the performer can change the conditions of the generating musical tone in accordance with a desired one of the n groups of preset data by turning on the preset switch-button of the preset switch-button group 22, which corresponds to the desired preset data group, without turning on the memory switch-button 23. In addition, the indicators incorporated in the switch-buttons of the tone control switch-button group 21 are turned on or off in accordance with the panel data $PNLDT_1$ to $PNLDT_{100}$, so that the performer can visually recognize the conditions of the generating musical.

Upon completing the above-described preset control processing 200, the CPU 62 outputs, at step 150, the switch detection control signal through the signal bus 50 to the foot switch 32 to read through the signal bus 50 switch-state data relating to the foot lever 30 from the above foot switch 32. The CPU 62 subsequently compares the read switch-state data with the switch-state data SWDT, stored in the working memory 63 and representing the preceding state of the foot lever 30, to detect a new turning-on operation of the foot lever 30. When the foot lever 30 has not been turned on, or when the foot lever 30 has been kept in the ON state, or when the foot lever 30 was released from the ON state, that is to say, when the foot lever 30 has not been newly turned on, the CPU 62 determines that there was no new turning-on operation of the foot lever 30. Thus, the result of the determination at the step 150 becomes "NO", so that the processing proceeds to step 160. In the case where the foot lever 30 was released from the ON state, the CPU 62 replaces at this step 150 the switch-state data SWDT in the working memory 63, which corresponds to the foot lever 30, with switch-state data representative of the release so that a new turning-on operation of the foot lever 30 can be detected at the same step 150 during the next pass.

Figure 6:
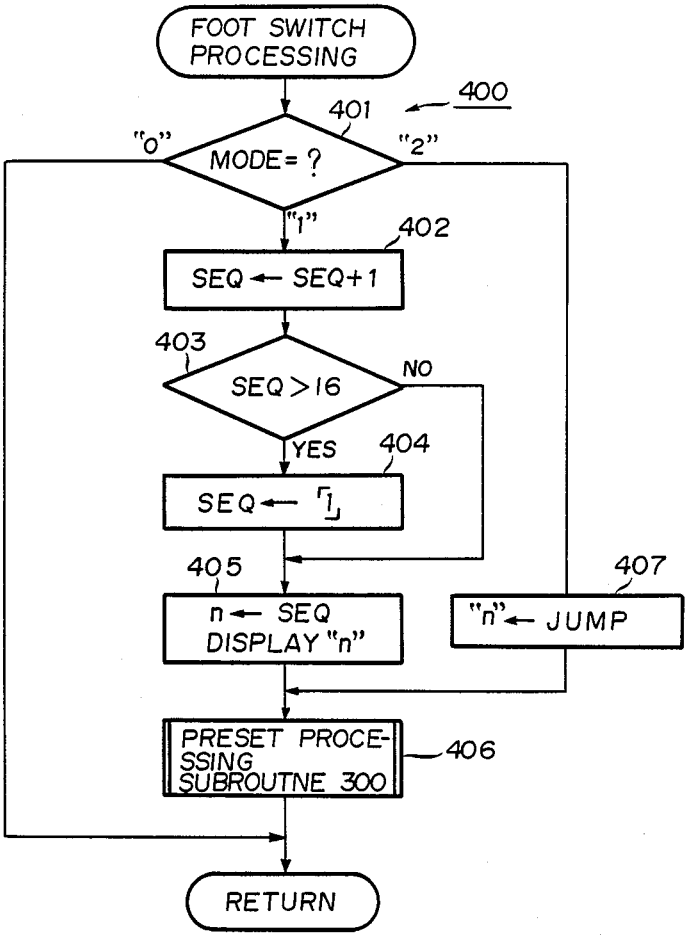
FIG. 6 is a flow chart of the foot switch processing subroutine 400 executed by the CPU 62 at the step 151 of FIG. 3.
Figure 7:
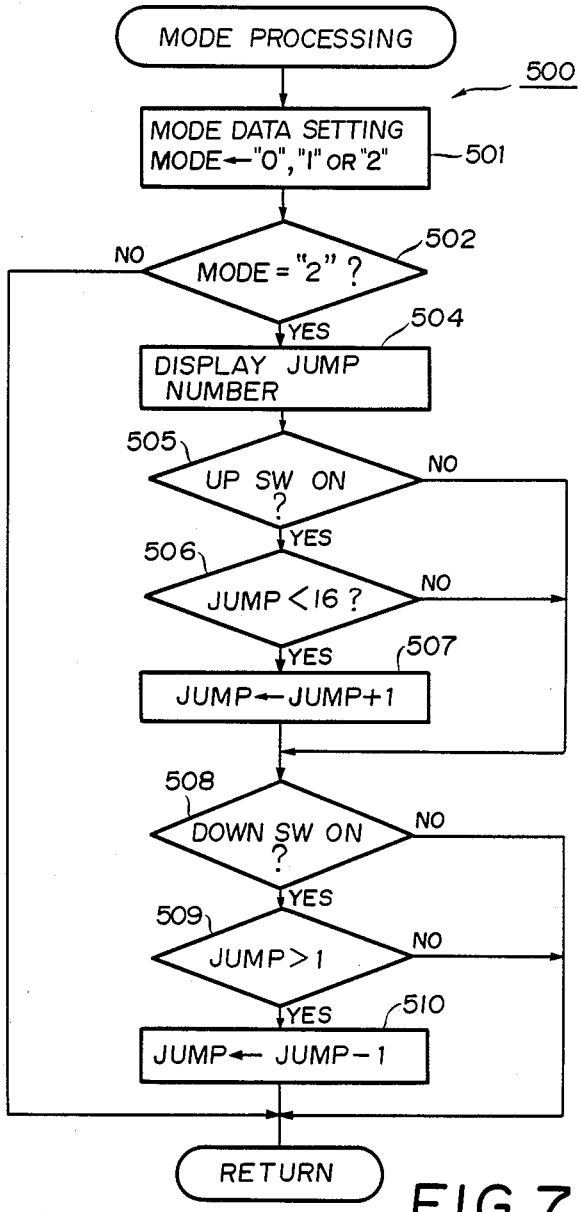
FIG. 7 is a flow chart of the mode processing subroutine 500 executed by the CPU 62 at the step 160 of FIG. 3.

On the other hand, when the foot lever 30 has been newly turned on, the result of the determination effected by the CPU 62 at the step 150 becomes "YES". In this case, the CPU 62 replaces at the step 150 the switch-state data SWDT in the working memory 63, which corresponds to the foot lever 30, with switch-state data representative of the turning-on operation so that a new turning-on operation of the foot lever 30 can be detected at the same step 150 during the next pass. At the next step 151, the CPU 62 reads a subroutine 400 for "foot switch processing", of which flow chart is shown in FIG. 6, from the program memory 61 and executes the foot switch processing subroutine 400.

The CPU 62 begins to execute the foot switch processing subroutine 400 from step 401 (FIG. 6) at which it is determined whether the mode data MODE is "0", "1" or "2", the mode data MODE being set to "0", "1" or "2" by a late-described processing in accordance with the operation of the mode selection switch-buttons $24_1$, $24_2$ or $24_3$. If the mode data MODE is "0", the CPU 62 terminates the execution of this switch processing subroutine 400. Thus, when the mode data MODE is "0", no processing is carried out even if the ooot lever 30 is turned on.

If it is determined that the mode data MODE is "1" at the step 401, the CPU 62 transfers its control to step 402 at which the sequence number SEQ is incremented by "1". At the next step 403, the CPU 62 determines whether the sequence number SEQ is greater than "16". When the sequence number SEQ is less than or equal to "16", the result of the determination at the step 403 becomes "NO", so that the processing proceeds to step 405. On the other hand, when the sequence number SEQ is greater than "16", the result of the determination at the step 403 becomes "YES", so that the processing proceeds to step 404 at which the sequence number SEQ is set to "1". Then, the processing proceeds to the next step 405. According to the processing of from the step 402 to the step 404, the sequence number SEQ is incremented by "1" or changed from "16" to "1". At the step 405, the CPU 62 sets the preset number "n" to a value equal to the sequence number SEQ, and outputs display control data representative of the preset number "n" to the display control circuit **20*b*. The display control circuit 20*b*, is responsive to the display control data to cause the display unit 27** to numerically display the preset number "n".

After completing the processing at the step 405, the CPU 62 reads the aforesaid preset processing subroutine 300 (see FIG. 5) from the program memory 61 and executes it. As a result, the panel data $PNLDT_1$ to $PNLDT_{100}$ are set to values equal to the preset data $PRSDT_{n,1}$ to $PRSDT_{n,100}$ in the nth preset data register group $64_n$ based on the preset number "n" Then, the conditions of the musical tone formed by the musical tone signal generating circuit 40 are controlled in accordance with the panel data $PNLDT_1$ to $PNLDT_{100}$. In this case, the indicators incorporated in the switch-buttons of the tone control switch-button group 21 are also turned on or off in accordance with the panel data $PNLDT_1$ to $PNLDT_{100}$. Thus, the selection of the preset data group $PRSDT_{n,1}$ to $PRSDT_{n.100}$ from the groups of the first preset data group $PRSDT_{1,1}$ to $PRSDT_{1,100}$ to the nth preset data group $PRSDT_{16,1}$ to $PRSDT_{16,100}$ is changed from one to another each time the foot lever 30 is turned on during performing a music in this second mode. Therefore, even when the performer is playing a music on the keyboard 10 with his both hands, he can still change at will the conditions of the musical tone by a simple operation of the foot lever 30. Upon completion of the processing at the step 406, the CPU 62 terminates the execution of this foot switch processing subroutine 400.

On the other hand when it is determined at the step 401 that the mode data MODE is "2", the CPU 62 transfers its control to step 407 at which the preset number "n" is set to a value equal to the jump number JUMP. Then, the CPU 62 executes at the step 406 the aforesaid preset processing subroutine 300, so that the panel data $PNLDT_1$ to $PNLDT_{100}$ are set to values equal to the preset data $PRSDT_{n,1}$ to $PRSDT_{n,100}$ in the nth preset data register group $64_n$ designated by the preset data "n" which is now equal to the jump number JUMP. The musical tone signal generating circuit 40 then controls the conditions of the musical tone formed thereby in accordance with the panel data $PNLDT_1$ to $PNLDT_{100}$. In this case, the indicators incorporated in the switch-buttons of the tone control switch-button group 21 are also turned on or off in accordance with the panel data $PNLDT_1$ to $PNLDT_{100}$, similarly to the aforesaid case of the second mode. Thus, the data group for controlling the conditions of the musical tone is changed to the preset data group $PRSDT_{n,1}$ to $PRSDT_{n,100}$ which corresponds to the jump number JUMP, when the foot lever 30 is turned on during performing a music in this third mode. Since the jump number JUMP can be set to any desired value by the performer as will be later described, the performer can change at will by a simple operation of the foot lever 30 the conditions of the musical tone to those predetermined by himself, even when he is playing a music on the keyboard 10 with his both hands. Upon completion of the processing at the step 406, the CPU 62 terminates the execution of this foot switch processing subroutine 400, and the processing returns to the main routine 100 at step 160 (FIG. 3).

At the step 160, the CPU 62 reads a subroutine 500 for "mode processing" from the program memory 61 and executes the subroutine 500. The CPU 62 begins to execute the mode processing subroutine 500 from step 501 (FIG. 7) at which the CPU 62 outputs the switch detection control signal through the signal bus 50 to those switches of the panel button switch circuit 20*a* which correspond respectively to the mode selection switch-buttons $24_1$, $24_2$ and $24_3$. The CPU 62 then reads through the signal bus 50 switch-state data relating to the above switch-buttons $24_1$, $24_2$ and $24_3$ from these switches of the panel button switch circuit 20*a*, and sets the mode data MODE to a value which corresponds to the read switch-state data. In this case, when the mode selection switch-button 241 is turned on, the mode data MODE is set to "0", and when the mode selection switch-button $24_2$ is turned on, the mode data MODE is set to "1". Similarly, when the mode selection switch-button $24_3$ is turned on, the mode data MODE is set to "2", and none of the mode selection switch-buttons $24_1$, $24_2$ and $24_3$ is turned on, the mode data MODE is kept unchanged. Thus, the mode data MODE is set to one of "0", "1" and "2" by a turning-on operation of the mode selection switch-button $24_1$, $24_2$ or $24_3$ by the performer. When the mode data MODE is set to a new value, the CPU 62 outputs to the display control circuit 20*b* display control data for turning on the indicator incorporated in that switch-button among the mode selection switch-buttons $24_1$, $24_2$ and $24_3$ which corresponds to the mode data MODE and for turning off the indicators incorporated in the other mode selection switch-buttons.

At the next step 502, the CPU 62 determines whether the mode data MODE is "2". When the result of the determination at the step 502 is "NO", that is, the mode data MODE is not equal to "2", the execution of this mode processing subroutine 500 is terminated. On the other hand, when the mode data MODE is equal to "2", the result of the determination at the step 502 becomes "YES", so that the processing proceeds to step 504 at which the CPU 62 outputs display control data representative of the jump number JUMP to the display control circuit 20*b*. The display control circuit 20*b* numerically displays the jump number JUMP on the display unit 27 in accordance with the supplied display control data.

Upon completing the processing at the step 504, the CPU 62 executes a jump number incrementing routine composed of steps 505 to 507 for incrementing the jump number JUMP, and also executes a jump number decrementing routine composed of steps 508 to 510 for decrementing the jump number JUMP. At the step 505 of the jump number incrementing routine, the CPU 62 outputs the switch detection control signal through the signal bus 50 to the switch of the panel button switch circuit 20*a* which corresponds to the up-control switch-button 25. The CPU 62 then reads through the signal bus 50 switch-state data relating to the up-control switch-button 25 from the above switch in the panel button switch circuit 20*a*, and determines in accordance with the read switch-state data whether the up-control switch 25 is in the ON state. If the up-control switch-button 25 is in the ON state, the result of the determination effected by the CPU 62 at the step 505 becomes "YES", so that the processing proceeds to the step 506. At this step 506, if it is determined that the jump number JUMP is less than "16", the processing proceeds to the step 507 at which the jump number JUMP is incremented by "1", and the processing of this jump number incrementing routine is finished. On the other hand, if the up-control switch-button 25 is not in the ON state, or if the jump number JUMP is not less than "16", either of the results of the determinations at the steps 505 and 506 becomes "NO", so that the processing of this jump number incrementing routine is finished without performing the processing of the step 507.

After completing the processing of the jump number incrementing routine, the CPU 62 begins to execute the jump number decrementing routine. More specifically, the CPU 62 outputs at the step 508 the switch detection control signal through the signal bus 50 to the switch of he panel button switch circuit 20*a* which corresponds to the down-control switch-button 26. The CPU 62 then reads through the signal bus 50 switch-state data relating to the down-control switch-button 26 from the above switch in the panel button switch circuit 20*a*, and determines in accordance with the read switch-state data whether the down-control switch 26 is in the ON state. If the down-control switch-button 26 is in the ON state, the result of the determination effected by the CPU 62 at the step 508 becomes "YES", so that the processing proceeds to step 509. At this step 509, if it is determined that the jump number JUMP is greater than "1", the processing proceeds to step 510 at which the jump number JUMP is decremented by "1", and the processing of this jump number decrementing routine is finished. On the other hand, if the down-control switch-button 26 is not in the ON state, or if the jump number JUMP is not greater than "1", either of the results of the determinations at the steps 508 and 509 becomes "NO", so that the processing of this jump number decrementing routine is finished without performing the processing of the step 510.

After completing the processing of the jump number increasing/decreasing routine, the CPU 62 returns its control cyclicly carries out the processing of the steps 110, 120, 121, 130 to 132, 140 to 142, 150, 151 and 160. In each pass of the above cyclic processing, the mode processing subroutine 500 is executed at the step 160, so that the mode data MODE is updated in accordance with each turning-on operation of the mode selection switch-buttons 241, 242 and 243. In this case, the jump number JUMP is increased or decreased in response to the turning-on operation of the up-control switch-button 25 or the down-control switch-button 26, so that the performer can determine at will, by properly operating the up-control switch-button 25 and the down-control switch-button 26, the preset data group among the first to sixteenth preset data groups which will be designated at the time when the foot lever 30 is turned on. Thus, when the foot lever 30 is turned on, the preset data group to be used is changed (or jumps) from the preset data group currently used to the preset data group designated by the jump number JUMP. In addition, since the jump number JUMP is displayed on the display unit 27 by the processing performed at the step 504, the performer can visually recognize to which preset data group such a jump is made.

With the above arrangement, the reading of each of the first to sixteenth preset data groups $PRSDT_{1,1}$ to $PRSDT_{1,100}$ . . . $PRSDT_{16,1}$ to $PRSDT_{16,100}$ is controlled in response to the operation of the foot lever 30 mounted on the expression pedal 31. However, the electronic musical instrument 5 may be modified to have, in place of the foot lever 30, a knee lever which can be actuated by the knee of his right leg moved in the right and left directions. The foot lever 30 may also be replaced with a large-sized switch-button mounted on the control panel 20 at a position which is spaced from the preset switch-button group 22 and easy to access for the performer with his hand. With the above-described embodiment, the foot lever 30 is use only for controlling the reading of each of the first to sixteenth preset data groups $PRSDT_{1,1}$ to $PRSDT_{1,100}$ . . . $PRSDT_{16,1}$ to $PRSDT_{16,100}$. However, additional modes, for example, for respectively controlling an auto-rhythm system (not shown) and an automatic accompaniment system (also not shown) may be provided so that the start and stop of the auto-rhythm system and those of the automatic accompaniment system can be controlled in the respective modes by operating the foot lever 30. The display unit 27 may also be used for other purposes, e. g., for numerically displaying the tempo of the automatic accompaniment system and for displaying the progress of the rhythm.

An electronic musical instrument including a musical tone control apparatus provided in accordance with a second embodiment of the invention will now be described.

This musical tone control apparatus is similar in structure to that of the electronic musical instrument 5 of FIG. 1, but is so arranged that the jump number JUMP is automatically set to a previously-stored value in response to a turning-on operation of each switch-button of the preset switch-button group 22. The musical tone control apparatus according to this second embodiment differs from the apparatus according to the first embodiment only in the following respects.

Figure 8:
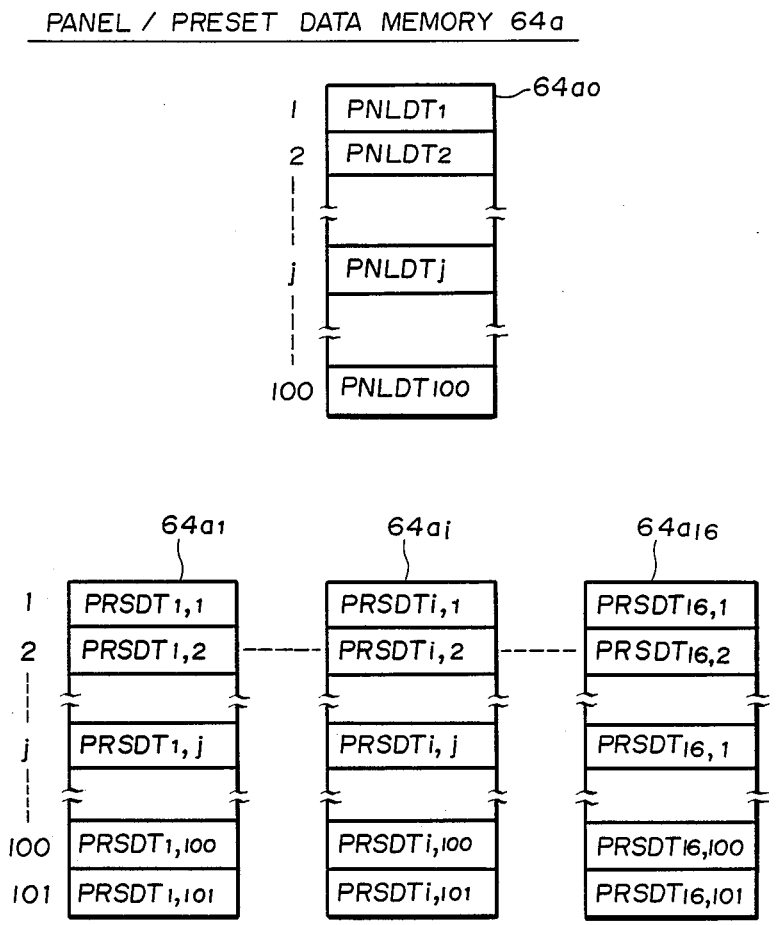
FIG. 8 is an illustration showing various registers provided in a panel/preset data memory 64*a* of an electronic musical instrument including a tone control apparatus according to a second embodiment of the present invention.

This musical tone control apparatus has, in place of the panel/preset data memory 64 shown in FIG. 1, a panel/preset data memory **64*a* shown in FIG. 8. The panel/preset data memory 64*a* includes a panel data register group 64*a* composed of a hundred pieces of panel data registers $PNLDT_1$ to $PNLDT_{100}$, the arrangement of these panel data registers $PNLDT_1$ to $PNLDT_{100}$ being the same as that of the panel data registers $PNLDT_1$ to $PNLDT_{100}$ of the panel/preset data memory 64 of FIG. 2. The panel/preset data memory 64*a*** further includes first to sixteenth preset data register groups $64a_1$ to $64a_{16}$. The first to sixteenth preset data register groups $64a_1$ . . . $64a_i$ . . . $64a_{16}$ respectively comprise a first group of first to 100th registers for respectively storing preset data $PRSDT_{1,1}$ to $PRSDT_{1,100}$ . . . an ith group of first to 100th registers for respectively storing preset data $PRSDT_{i,1}$ to $PRSDT_{i,100}$ . . . a sixteenth group of first to 100th registers for respectively storing preset data $PRSDT_{16,1}$ to $PRSDT_{16,100}$. The first to sixteenth preset data register groups $64a_1$ . . . $64a_i$ . . . $64a_{16}$ further comprise 101st preset data registers for storing preset data $PRSDT_{1,101}$ . . . $PRSDT_{i,101}$ . . . $PRSDT_{16,101}$, respectively. These additional sixteen 101st preset data registers are provided for respectively storing the jump numbers JUMP as the preset data $PRSDT_{1,101}$ to $PRSDT_{16,101}$.

Figure 9:
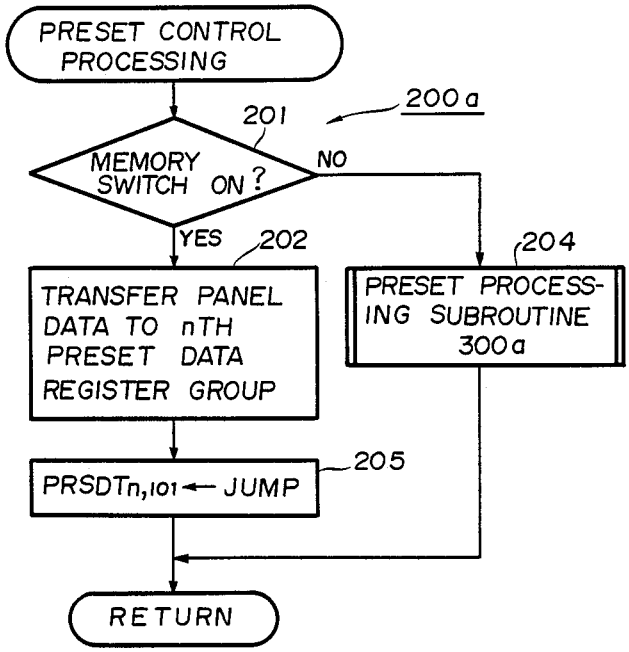
FIG. 9 is a flow chart of a preset control processing subroutine 200*a* executed by the CPU 62 of the electronic musical instrument including the tone control apparatus according to the second embodiment of the present invention.
Figure 10:
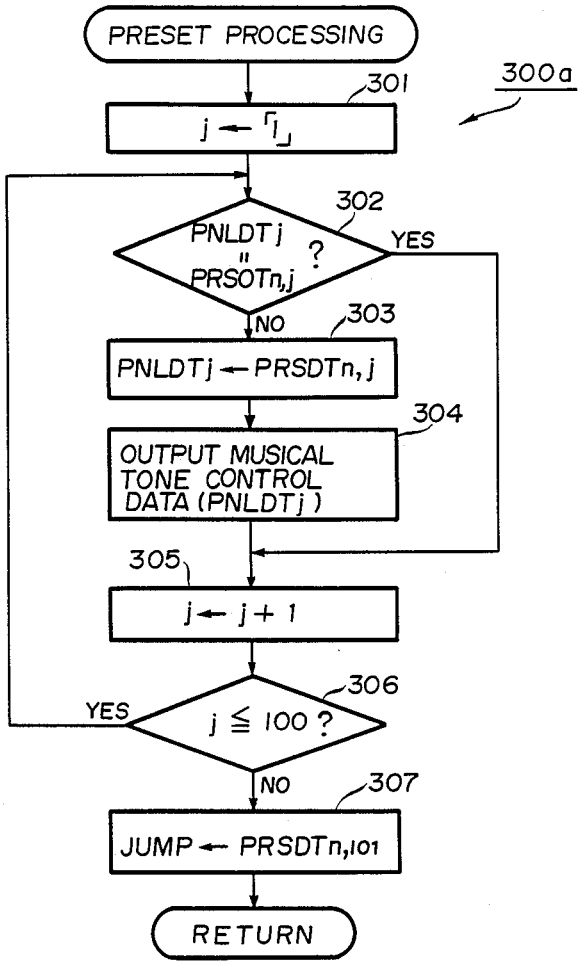
FIG. 10 is a flow chart of a preset processing subroutine 300*a* executed by the CPU 62 of the electronic musical instrument including the tone control apparatus according to the second embodiment of the present invention.

The program memory 61 of this musical tone control apparatus stores, in place of the preset control processing subroutine 200 of FIG. 4 and the preset processing subroutine 300 of FIG. 5, a preset control processing subroutine **200*a* of FIG. 9 and a preset processing subroutine 300*a* of FIG. 10**, respectively.

As shown in FIG. 9, the preset control processing subroutine **200*a* differs from the preset control processing subroutine 200 only in that it includes at step 205 an additional processing to be performed after the step 202. At this step 205, the CPU 62** stores the jump number JUMP into the 101st register of the nth preset data register group $64a_n$ as the preset data $PRSDT_{n,101}$.

With this preset control processing subroutine **200*a*, when one of the switch-buttons of the preset switch-button group 22 is turned on with the memory switch-button 23 being in the ON state, the CPU 62 stores at the step 202 the panel data $PNLDT_1$ to $PNLDT_{100}$ respectively into the first to 100th registers of that group of the first to 16th preset data register groups $64a_1$ to $64a_{16}$ which corresponds to the preset switch-button turns turned on. Then, the CPU 62 stores at the next seep 205 the jump number JUMP into the 101st register of the same preset data register group as the 101st preset data. In this case, the jump number JUMP should previously be set to a desired value by operating the up-control switch-button 25 and the down-control switch-button 26 (see the mode processing subroutine 500 of FIG. 7**).

As shown in FIG. 10, the preset processing subroutine **300*a* of this apparatus differs from the preset processing subroutine 300 of FIG. 5 only in that it includes at step 307 an additional processing to be performed after the processing at the step 306. At this step 307, the CPU 62** set the jump number JUMP to a value equal to the preset data $PRSDT_{n,101}$ contained in the 101st register of the nth preset data register group $64a_n$.

With this preset processing subroutine **300*a*, when any one of the switch-buttons of the preset switch-button group 22 is turned on with the memory switch-button 23 being in the OFF state, all the panel data $PNLDT_1$ to $PNLDT_{100}$ are replaced respectively with the first to 100th preset data contained in that register group among the first to 16th preset data register groups $64a_1$ to $64a_{16}$ which corresponds to the preset switch-button thus turned on. The conditions of the musical tone formed by the musical tone signal generating circuit 40 are controlled in accordance with these panel data $PNLDT_1$ to $PNLDT_{100}$. Then, by the processing at the step 307, the jump number JUMP is set to a value equal to the 101st preset data contained in the above preset data register group. Even after the processing at this step 307, the jump number JUMP can be altered by operating the up-control switch-button 25 and the down-control switch-button 26**, in a manner as described above for the first embodiment.

With this second embodiment, the performer can store sixteen kinds of jump numbers JUMP correspondingly to the respective preset data groups in advance of performing a music. The performer can therefore carry out the setting of the jump number JUMP simultaneously with the reading of the preset data. Thus, with this arrangement, the number of operations of the switch-buttons or lever during performing a music can be substantially reduced, so that the electronic musical instrument can be operated more easily.

What is claimed is:

1. A tone control apparatus in an electronic musical instrument comprising:

(a) a tone-frequency designating means for outputting a frequency-designation signal which designates a frequency of a musical tone to be generated;

(b) musical tone generating means responsive to said frequency-designation signal for generating a musical tone having said frequency designated by said tone-frequency designating means;

(c) memory means for storing a plurality of groups of tone control data, wherein each group includes a plurality of tone control data which are used for controlling plural conditions of said musical tone generated by said musical tone generating means;

(d) signal generating means having a manually operable member mounted on the electronic musical instrument for generating an operation signal each time said member is operated; and (e) reading means for reading said plurality of control data groups from said memory means one by one in a predetermined order in synchronization with the operation signals generated by said signal generating means, said musical tone generating means being further responsive to each control data group read by said reading means for controlling said conditions of said generated musical tone.

2. A tone control apparatus according to claim 1 further comprising a group of plural switch means for respectively designating said conditions of said musical tone, and storing means for storing states of said group of switch means into said memory means as one of said plurality of tone control data groups.

3. A tone control apparatus according to claim 1 further comprising a group of plural switch means each corresponding to a respective one of said plurality of tone control data groups stored in said memory means, and second reading means responsive to an output of each of said group of switch means for reading a respective one of said plurality of tone control data groups from said memory means, said musical tone generating means further controlling said conditions of said generated musical tone in response to each control data group read by said second reading means.

4. A tone control apparatus according to claim 1 further comprising designation data providing means for providing designation data designating a desired one of the plurality of tone control data groups, and mode selection means for selecting one of a first mode and a second mode, and wherein said reading means reads said plurality of control data groups from said memory means one by one in said predetermined order in synchronization with said operation signals when said first mode is selected, said reading means being responsive to said operation signal and said designation data to read said designated tone control data group from said memory means when said second mode is selected.

5. A tone control apparatus according to claim 4, wherein said designation data providing means comprises variable data generating means having manually operable switch means for generating data which varies in accordance with operation of said manually operable switch means and register means for storing said variable data and for outputting said stored variable data as said designation data.

6. A tone control apparatus according to claim 5 further comprising second memory means having a plurality of addresses provided correspondingly to said plurality of tone control data for respectively storing said variable data, wherein said reading means is responsive to said operation signal and said designation data in said register means to read said designated tone control data group from said memory means when said second mode is selected, said reading means being further responsive to said operation signal and said designation data in said register means to read said variable data from one of said addresses corresponding to said designated tone control data group and to store said read variable data into said register means when said second mode is selected.

7. A tone control apparatus according to claim 6 further comprising a group of plural switch means each corresponding to a respective one of said plurality of tone control data groups stored in said memory means, and wherein said second memory means further comprises second storing means responsive to an output of each of said group of switch means for storing said variable data generated by said variable data generating means into one of said addresses which corresponds to said each of said group of switch means.

8. A tone control apparatus according to any one of claim 1 to claim 7, wherein said conditions of said musical tone controlled in accordance with said read tone control data group include at least one of a tone pitch, a tone color, a tone volume and a tone effect of said musical tone.

9. A tone control apparatus according to any one of claim 1 to claim 7, wherein said manually operable member is a foot lever for being operated by the foot a performer.

10. A tone control apparatus according to any one of claim 1 to claim 7, wherein said manually operable member is a knee lever for being operated by the knee of a performer.

11. A tone control apparatus in an electronic musical instrument comprising:

(a) tone-frequency designating means for outputting a frequency-designation signal which designates a frequency of a musical tone to be generated;

(b) musical tone generating means responsive to said frequency-designation signal for generating a musical tone having said frequency designated by said tone-frequency designating means;

(c) memory means for storing a plurality of groups of tone control data, wherein each group includes a plurality of tone control data which are used for controlling the plural conditions of said musical tone generated by said musical tone generating means;

(d) a group of plural preset switch means each corresponding to a respective one of said tone control data groups stored in said memory means, for selecting one of said groups for controlling conditions of a musical tone to be generated;

(e) signal generating means having a manually operable member mounted on the electronic musical instrument for generating an operation signal each time said member is operated;

(f) designation data providing means for providing designation data designating one of said plurality of tone control data groups; and (g) reading means responsive to said operation signal for reading, from said memory means, the control data group designated by said designation data, said musical tone generating means being further responsive to said read control data group for controlling said conditions of said generated musical tone regardless of the state of the preset switch means.

12. A tone control apparatus according to claim 11 further comprising a group of plural tone control switch means for respectively designating said conditions of said musical tone, and storing means for storing states of said group of tone control switch means into said memory means as one of said plurality of tone control data groups.

13. A tone control apparatus according to claim 11 further comprising second reading means responsive to an output of each of said group of plural preset switch means for reading a respective one of said plurality of tone control data groups from said memory means, said musical tone generating means further controlling said conditions of said generated musical tone in response to each control data group read by said second reading means.

14. A tone control apparatus according to claim 11, wherein said designation data providing means comprises:

variable data generating means having manually operable switch means for generating variable data which varies in accordance with operation of said manually operable switch means; and register means for storing said variable data and for outputting said stored variable data as said designation data.

15. A tone control apparatus according to claim 11, wherein said designation data providing means comprises second memory means having a plurality of addresses provided correspondingly to said plurality of tone control data groups each for storing additional control data, said reading means further reading the additional control data from the address corresponding to said designated tone control data group as said designation data.

16. A tone control apparatus according to claim 15, wherein said designation data providing means further comprises:

variable data generating means having manually operable switch means for generating variable data which varies in accordance with operation of said manually operable switch means; and storing means for storing said variable data selectively into one of said addresses as said additional control data.

17. A tone control apparatus according to claim 16, wherein said storing means comprises a group of plural switch means each corresponding to a respective one of said plurality of tune control data groups in said memory means, and stores said variable data into one of said addresses which corresponds to an operated one of said plural switch means as said additional control data.

18. A tone control apparatus according to any one of claim 11 to claim 17, wherein said conditions of said musical tone controlled in accordance with said read tone control data group include at least one of a tone pitch, a tone color, a tone volume and a tone effect of said musical tone.

19. A tone control apparatus according to any one of claim 11 to claim 17, wherein said manually operable member is a foot lever for being operated by the foot of a performer.

20. A tone control apparatus according to any one of claim 11 to claim 17, wherein said manually operable member is a knee lever for being operate by the knee of a performer.

* * * * *